US006976280B2

(12) United States Patent
Coutts

(10) Patent No.: US 6,976,280 B2
(45) Date of Patent: Dec. 20, 2005

(54) CONTOUR ADJUSTING PILLOW

(76) Inventor: Alexander Taylor Coutts, 98 Mariner Green Dr., Corte Madera, CA (US) 94925

( * ) Notice: Subject to any disclaimer, the term of this patent is extended or adjusted under 35 U.S.C. 154(b) by 0 days.

(21) Appl. No.: 10/745,849

(22) Filed: Dec. 23, 2003

(65) Prior Publication Data

US 2005/0132496 A1 Jun. 23, 2005

(51) Int. Cl.[7] ..... A47G 9/00
(52) U.S. Cl. ..... 5/636; 5/640; 5/637
(58) Field of Search ..... 5/636–637, 630, 5/640, 730

(56) References Cited

U.S. PATENT DOCUMENTS 2,795,802 A * 6/1957 Myers ..... 5/632
3,243,828 A * 4/1966 McCarty ..... 5/636
3,757,364 A * 9/1973 Downing ..... 5/636
5,033,137 A * 7/1991 Pedrow ..... 5/636
D388,648 S * 1/1998 Bates ..... D6/601
5,937,460 A * 8/1999 Humphries ..... 5/640

* cited by examiner

*Primary Examiner*—Heather Shackelford
*Assistant Examiner*—Fredrick Conley
(74) *Attorney, Agent, or Firm*—Risto A. Rinne, Jr.

(57) ABSTRACT

An apparatus for resting a head of a user during sleep has a layer of closed cell foam disposed over a layer of open cell foam. A section of the apparatus that resembles a quarter moon in shape is removed to allow space for a head and shoulders of a user to better engage with the pillow sufficient to retain the user in a position of cooperation with the pillow. A pair of spaced-apart parallel cuts is provided from one end of the pillow to a depth of approximately two-thirds of the pillow to provide three hinged portions that are adapted to accommodate a portion of an arm or hand of the user that may be inserted under the pillow.

5 Claims, 1 Drawing Sheet

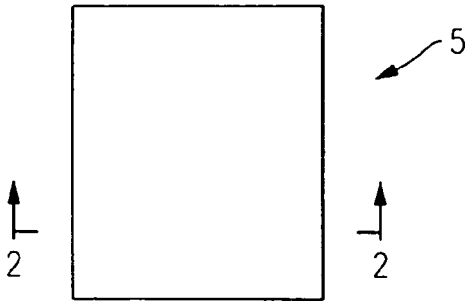
FIG.1
Prior Art
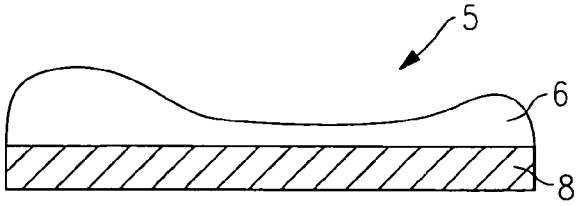
FIG.2
Prior Art
FIG.3
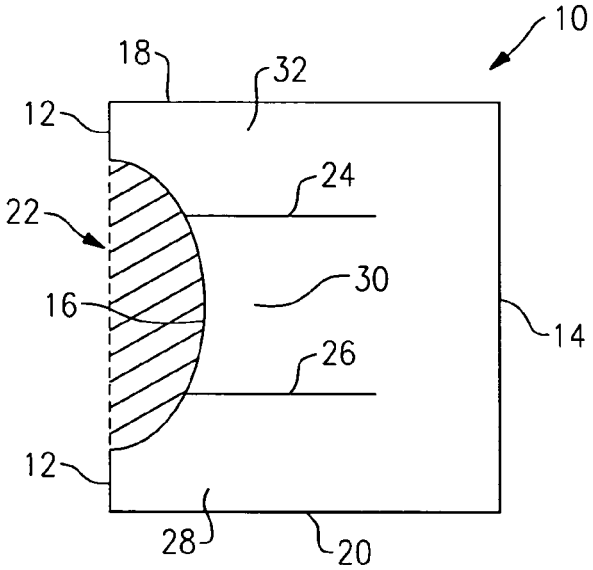
FIG.4
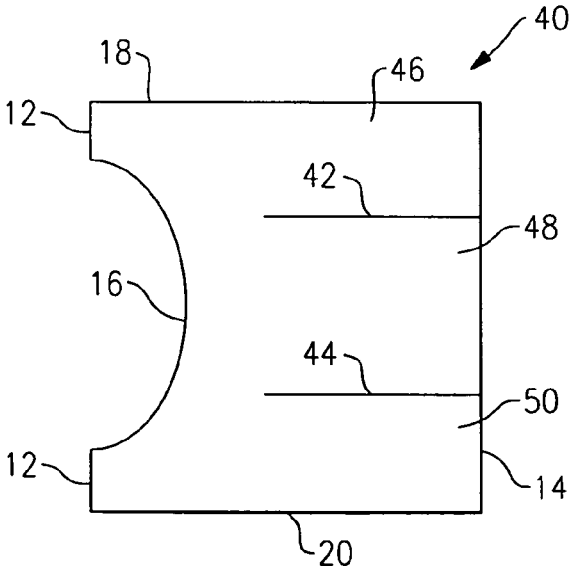

CONTOUR ADJUSTING PILLOW

BACKGROUND OF THE INVENTION

1. Field of the Invention

The present invention, in general relates to pillows and, more particularly, to pillows that contain different densities of foam.

Pillows are well known and are used to elevate a head during sleep or rest. By elevating the head, pillows keep the spinal column aligned and help promote sleep without irritation.

The search for an ideal pillow has included a variety of fill materials and shapes. Earlier, goose down was regarded as a superior material. Today, it is generally believed to provide less than optimum support.

Various density foams are also used. The problem with any one given density of foam is that if adequate lift is provided, it tends to feel too stiff and if a softer fill material is selected so that it feels acceptable inadequate lift is then provided.

Accordingly, state of the art pillow design has included the use of dual density types of foam material. While this is the current state of the art, there is still a difficulty in adjusting the pillow for optimum comfort and fit.

This is because the contour of the head and shoulders is such that a person tends to shift (i.e., roll) off of the pillow during sleep. If a person rolls out of cooperation with a well designed pillow, the person experiences a transition from a well conceived sleep position to one of essentially no support and the person may awake feeling considerable physical discomfort and as if he or she had a poor rest or sleep.

It is therefore desirable to embed a person in a pillow in such a manner that the person tends to stay in cooperation with the pillow for the entire night or at least the bulk of it. The word "night" is used to indicate the time allotted for sleep or rest and can of course be during daylight hours for those who sleep during the day.

Also, prior designs do not adequately take into account the arms of the person sleeping. For many people, they prefer to insert an arm underneath a portion of the pillow during sleep. Prior art designs of pillows, especially foam and dual density types of foam pillows, do not readily accommodate an arm underneath. A pressure point is created by the hand or arm that also tends to elevate the entire pillow. Stress is also placed upon the arm or hand, resulting in possible poor circulation.

Accordingly, there exists today a need for a contour adjusting pillow that helps to ameliorate the above-mentioned difficulties.

Clearly, such an apparatus would be a useful and desirable device.

2. Description of Prior Art

Pillows are, in general, known. For example, a dual density type of pillow is marketed on the Internet at www-.contourcloud.com at telephone number 800 950-0230.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a contour adjusting pillow that is comfortable to sleep or rest on.

It is also an important object of the invention to provide a contour adjusting pillow that helps to retain a person in cooperation with the pillow during sleep (unconsciousness).

Another object of the invention is to provide a contour adjusting pillow that helps prevent a person from rolling out of a position of cooperation with the pillow during sleep.

Still another object of the invention is to provide a contour adjusting pillow that adjusts for a hand that is placed under the pillow.

Still yet another object of the invention is to provide a contour adjusting pillow that adjusts for a portion of an arm that is placed under the pillow.

Yet another important object of the invention is to provide a contour adjusting pillow that adjusts for a portion of an arm and a hand that are placed under the pillow.

Still yet another important object of the invention is to provide a contour adjusting pillow that does not excessively elevate any portion of the pillow if either a portion of an arm or hand are placed underneath the pillow.

Briefly, a contour adjusting pillow that is constructed in accordance with the principles of the present invention has a closed cell foam on top over a layer of open cell. An arcuate portion is removed to allow space for a head and shoulders to engage the pillow. A pair of spaced-apart parallel cuts is provided from one end of the pillow to a depth of approximately two-thirds of the pillow to accommodate a portion of an arm or hand that may be inserted under the pillow.

BRIEF DESCRIPTION OF THE DRAWINGS

FIG. 1 is a top view of a PRIOR ART pillow.

FIG. 2 is a cross sectional view taken on the line 2—2 of the PRIOR ART pillow of FIG. 1.

FIG. 3 is a top view of a contour adjusting pillow.

FIG. 4 is a top view of a modified contour adjusting pillow.

DETAILED DESCRIPTION OF THE INVENTION

Referring to FIG. 1 and FIG. 2 is shown, a PRIOR ART type of pillow, identified in general by the reference numeral 5. An upper layer of a closed cell 6 high density of foam is disposed over a lower layer of an open cell 8 lower density type of foam. The closed cell foam 6 adapts to the shape of the head while the open cell foam 8 provides a softer, suppler base.

Referring now to FIG. 3 is shown, a contour adjusting pillow, identified in general by the reference numeral 10. The contour adjusting pillow may include the dual density closed cell foam 6 over the open cell foam 8 of the prior art or it may include any single density of foam or even a triple layering of various densities of foam as may be desired.

The pillow 10 includes a first side 12 that is intended to abut the shoulders of a user (not shown). An opposite second side 14 is intended to be disposed away from the shoulders. If the pillow 10 includes an asymmetrical configuration, either of the longer sides of a generally rectangular shaped pillow 10 may be used as the first side 12.

Beginning on the first side 12, an arcuate cut 16 is provided into the pillow 10. The arcuate cut 16 begins on the first side 12 near a first edge 18 and extends inward in an arc, reversing direction, and then back out to the first side 12 near a second opposite edge 20.

A section is removed, identified in general by the reference numeral 22. The section 22 includes a flat portion of the first side 12 and corresponds with the curvature of the arcuate cut 16 for the rest of its shape. The section 22 generally resembles a "quarter moon," in plan view.

The space left by removal of the section 22 allows a user (not shown) to embed himself or herself deeper into the pillow 10. A space is thereby provided that is adapted to accept a portion of the shoulders and upper torso area of the user within the overall rectangular outline of the pillow 10.

Accordingly, the user is retained in the pillow 10 during sleep and the pillow 10 itself provides restraint that helps to keep the user from rolling out of a position of cooperation with the pillow 10 during the night.

A first cut 24 extends from one side of the arcuate cut 16 parallel with the first edge 18 toward the second side 14 but not reaching it. The length of the first cut 24 is approximately two-thirds to three-quarters of the overall length of the first edge 18.

A second cut 26 is similarly provided that extends from the opposite side of the arcuate cut 16 parallel with the second edge 20 toward the second side 14 a depth that is equal to the first cut 24.

Together, the first cut 24 and the second cut 26 provide a segmenting of the pillow 10 into three portions, identified as 28, 30, and 32 that are hinged to the section that is near the second side 26 at a depth where the first and second cuts 24, 26 end. Any of the three portions 28, 30, 32 are able to pivot upward with respect to the remaining portions 28–32 if a hand or portion of an arm (not shown) is inserted under the pillow 10. This relieves stress upon the arm or hand and it also prevents raising of the pillow 10 an undesirable amount for sleep.

Accordingly, the user is retained in a position of cooperation with the pillow 10 and is also able to comfortably place a hand or portion of the arm or both underneath the pillow 10 without adversely affecting the positioning and functioning of the pillow 10.

Referring now to FIG. 4, is shown a modified contour adjusting pillow, identified by the reference numeral 40. The modified pillow 40 is similar to the pillow 10 except the first and second cuts 24, 26 are eliminated and replaced by a modified first cut 42 and a modified second cut 44.

The modified first cut 42 extends from the second side 14 toward the arcuate cut 16 as does the spaced-apart parallel modified second cut 44. Both the modified first and second cuts 42, 44 do not reach the arcuate cut 16. Three modified portions are provided 46, 48, 50 that are also independently hinged with respect to a remaining portion of the modified pillow 40 at a location where the modified cuts 42, 44 end.

Any of the modified portions 46-50 can elevate to accommodate the arm or hand of the user, as was previously described for the portions 28–32 of the pillow 10. The difference is whether the hinge area is disposed nearest the first side 12 (the pillow 10) or nearest the second side 14 (the modified pillow 40). Both versions provide the benefits herein described.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An improved pillow of the type having a foam core, wherein the improvement comprises:

wherein said pillow includes a generally rectangular overall shape when viewed from a top surface and wherein said pillow includes an opposite bottom surface that is disposed in a plane and wherein said pillow includes a first side and an opposite second side that extend from said top surface to said bottom surface and wherein said first side and said second side each define a perimeter and a width of said pillow and including a third side and an opposite fourth side that extend from said top surface to said bottom surface and wherein said third side and said fourth side each define a perimeter and a length of said pillow and wherein said third side and said fourth side are disposed intermediate said first side and said second side and wherein said length is greater than said width and wherein said third side of said pillow is adapted for placement proximate a user, said third side including a first flat edge having a first end and an opposite second end, said first end disposed at a juncture of said third side and said first side and extending a predetermined distance toward said fourth side and wherein a first end of an arcuate inner shape is disposed at said second end of said first flat edge and wherein said arcuate inner shape includes a radius that extends toward said fourth side and wherein said arcuate inner shape extends entirely through said pillow, and wherein said arcuate inner shape provides a space that is adapted to receive a portion of an upper torso of said user therein, and wherein said arcuate inner shape includes an opposite second end that is disposed at a first end of a second flat edge, said second flat edge disposed along said third side and wherein said second flat edge includes an opposite second end thereof that is disposed at a juncture of said third side and said second side and wherein said pillow includes a pair of parallel spaced apart cuts through said pillow that are in parallel planar alignment with said first and second sides and wherein said pair of parallel spaced apart cuts extend through said pillow from said top surface to said bottom surface and wherein said pair of parallel spaced apart cuts do not extend along the entire width of said pillow; and wherein said pair of parallel spaced apart cuts begin at said fourth side and extend a predetermined distance toward said third side.

2. The improved pillow of claim 1 wherein said pair of parallel spaced apart cuts begin at said third side and extend a predetermined distance toward said fourth side.

3. The improved pillow of claim 1 wherein said pair of parallel spaced apart cuts begin at said arcuate inner shape and extend a predetermined distance toward said fourth side.

4. An improved pillow of the type having a layer of closed cell foam over a layer of open cell foam, wherein the improvement comprises:

wherein said pillow includes a generally rectangular overall shape when viewed from a top surface and wherein said pillow includes an opposite bottom surface that is disposed in a plane and wherein said pillow includes a first side and an opposite second side that extend from said top surface to said bottom surface and wherein said first side and said second side each define a perimeter and a width of said pillow and including a third side and an opposite fourth side that extend from said top surface to said bottom surface and wherein said third side and said fourth side each define a perimeter and a length of said pillow and wherein said third side and said fourth side are disposed intermediate said first side and said second side and wherein said length is greater than said width and wherein said third side of said pillow is adapted for placement proximate a user, said third side including a first flat edge having a first end and an opposite second end, said first end disposed at a juncture of said third side and said first side and extending a predetermined distance toward said fourth side and wherein a first end of an arcuate inner shape is disposed at said second end of said first flat edge and wherein said arcuate inner shape includes a radius that extends toward said fourth side and wherein said arcuate inner shape extends entirely through said pillow, and wherein said arcuate inner shape provides a space that is adapted to receive a portion of an upper torso of said user therein, and wherein said arcuate inner shape includes an opposite second end that is disposed at a first end of a second flat edge, said second flat edge disposed along said third side and wherein said second flat edge includes an opposite second end thereof that is disposed at a juncture of said third side and said second side and wherein said pillow includes a pair of parallel spaced apart cuts through said pillow that are in parallel planar alignment with said first and second sides and wherein said pair of parallel spaced apart cuts extend through said pillow from said top surface to said bottom surface and wherein said pair of parallel spaced apart cuts do not extend along the entire width of said pillow and wherein each of said pair of spaced apart cuts begins at said arcuate inner shape and extends toward said fourth side.

5. The improved pillow of claim 4 wherein each of said pair of spaced apart cuts begin at said fourth side of said pillow and extend a predetermined distance toward said third side.

* * * * *